US007983396B2

(12) United States Patent
Bertozzi et al.

(10) Patent No.: US 7,983,396 B2
(45) Date of Patent: Jul. 19, 2011

(54) THIN WALLED TUBE RADIATOR FOR BREMSSTRAHLUNG AT HIGH ELECTRON BEAM INTENSITIES

(75) Inventors: William Bertozzi, Lexington, MA (US); Michael Donovan, Dover, MA (US); Alexei Klimenko, Tyngsboro, MA (US); Stephen E. Korbly, Acton, MA (US); William Park, Somerville, MA (US)

(73) Assignee: Passport Systems, Inc., Billerica, MA (US)

( * ) Notice: Subject to any disclaimer, the term of this patent is extended or adjusted under 35 U.S.C. 154(b) by 0 days.

(21) Appl. No.: 12/121,515

(22) Filed: May 15, 2008

(65) Prior Publication Data

US 2008/0310595 A1 Dec. 18, 2008

Related U.S. Application Data

(60) Provisional application No. 60/938,235, filed on May 16, 2007.

(51) Int. Cl.
*H01J 35/18* (2006.01)
*H01J 35/10* (2006.01)

(52) U.S. Cl. ..... 378/141; 378/119

(58) Field of Classification Search ..... 378/141, 378/119, 140

See application file for complete search history.

(56) References Cited

U.S. PATENT DOCUMENTS

| | | | | |
|---|---|---|---|---|
| 1,967,869 | A * | 7/1934 | Coolidge | 378/140 |
| 2,903,611 | A * | 9/1959 | Raine | 378/121 |
| 3,999,096 | A * | 12/1976 | Funk et al. | 378/143 |
| 4,843,246 | A * | 6/1989 | Benes et al. | 250/491.1 |
| 5,065,420 | A * | 11/1991 | Levene | 378/137 |
| 5,115,459 | A | 5/1992 | Bertozzi | |
| 5,420,905 | A | 5/1995 | Bertozzi | |
| 5,428,658 | A | 6/1995 | Oettinger et al. | |
| 5,680,433 | A * | 10/1997 | Jensen | 378/141 |
| 6,107,635 | A | 8/2000 | Palathingal | |
| 6,385,292 | B1 * | 5/2002 | Dunham et al. | 378/122 |
| 6,463,123 | B1 * | 10/2002 | Korenev | 378/69 |
| 6,761,851 | B1 * | 7/2004 | Chappas | 266/107 |
| 7,120,226 | B2 | 10/2006 | Ledoux et al. | |
| 7,286,638 | B2 | 10/2007 | Ledoux et al. | |
| 7,372,262 | B2 | 5/2008 | Bertozzi et al. | |
| 7,409,042 | B2 | 8/2008 | Bertozzi et al. | |
| 2002/0101958 | A1 * | 8/2002 | Bertsche | 378/143 |
| 2004/0165699 | A1 * | 8/2004 | Rusch et al. | 378/119 |
| 2006/0126789 | A1 * | 6/2006 | Dinsmore et al. | 378/121 |

OTHER PUBLICATIONS

International Search Report and Written Opinion for PCT/US08/63754, Apr. 2007.

*Geant4 Developments and Applications*, J. Allison et al., IEEE Transactions on Nuclear Science, vol. 53, No. 1, Feb. 2006, pp. 270-278.

(Continued)

*Primary Examiner* — Hoon Song
*Assistant Examiner* — Mona M Sanei
(74) *Attorney, Agent, or Firm* — Foley Hoag LLP

(57) ABSTRACT

Methods and systems for generating bremsstrahlung with enhanced photon flux in a narrow cone at forward angles utilize a thin target of a high-Z material such as gold as radiator, supported on a tube of a low-Z material such as titanium, which tube contains a circulating fluid such as water which acts as a coolant and also may absorb the incident electron beam.

43 Claims, 12 Drawing Sheets

OTHER PUBLICATIONS

*Geant4—A Simulation Toolkit*, S. Agostinelli et al., Nuclear Instruments and Methods in Physics Reasearch A 506 (2003) pp. 250-303.

*A Heat Transfer Textbook*, JH Lienhard IV et al., 3rd edition, 2006, Phlogiston Press, Cambridge, MA, p. 496.

* cited by examiner

THIN WALLED TUBE RADIATOR FOR BREMSSTRAHLUNG AT HIGH ELECTRON BEAM INTENSITIES

PRIORITY CLAIM

This application claims priority to the following provisional patent application, the entirety of which is expressly incorporated herein by reference: U.S. Ser. No. 60/938,235 filed on May 16, 2007, entitled "THIN WALLED TUBE RADIATOR FOR BREMSSTRAHLUNG AT HIGH ELECTRON BEAM INTENSITIES."

STATEMENT REGARDING FEDERALLY SPONSORED RESEARCH OR DEVELOPMENT

This invention was made with government support under Passport Systems, Inc. Subcontract No. 1358-PSI, D.O. 0001 issued by American Science & Engineering under Contract No. HSHQDC-06-D-0073 awarded by The Department of Homeland Security. The government has certain rights in the invention.

BACKGROUND

1. Field

The methods and systems disclosed herein relate to generating bremsstrahlung with beams of electrons having high intensity and high areal densities that enhance the photon flux in a narrow cone at forward angles while suppressing the radiation at large angles.

2. Background Information

The use of bremsstrahlung as a source of photons may find application in many modalities that require a large photon flux spread over a large area. Such an application may use a thick target such as tantalum, tungsten or another high-Z material that has a relatively small radiation length and efficiently converts the kinetic energy of an electron into radiation energy. The thick target not only may provide efficient radiation, it also may spread the electron beam in angle via multiple scattering which in turn may help to spread the radiation pattern over angles much greater than the natural angle of thin target bremsstrahlung given by $\sim 1/\gamma$, where $\gamma$ is the ratio of the electron rest mass to the total electron energy, $mc^2/E$. In such applications the electron beam may often be swept over the high-Z radiator to further spread the radiation pattern. Practical aspects such as the need to cool the targets may limit the total electron beam power and its areal density and for high intensities continuous operation at one beam position may not be possible.

In other applications, by contrast, it may be desired to use a bremsstrahlung beam confined to a narrow cone in order to define a small region of space to be irradiated. In this case the intensity of the beam usually may be desired to be approximately uniform over the narrow aperture of the cone. Any radiation outside the cone may not be useful. In fact, shielding may be required to prevent the interference of signals from other regions, to prevent background in detectors, and also for reasons of personnel safety. In such situations the use of thinner bremsstrahlung targets than those discussed above may be advantageous because less radiation is generated in the angles where the radiation is not useful.

In these situations multiple scattering plays an important role as the physical phenomenon that allows the angular distribution of the bremsstrahlung to be broadened beyond $1/\gamma$. As an example, for a beam of electrons of 10 MeV kinetic energy (10.51 MeV total energy, E), the natural angle of thin target bremsstrahlung ($mc^2/E$) is approximately 0.049 radians or 2.7 degrees. As a bremsstrahlung target is increased in thickness the multiple scattering soon becomes considerably larger than 2.7 degrees and the intensity at zero degrees no longer increases linearly with thickness. In fact the intensity almost saturates with increasing thickness. The bremsstrahlung beam simply grows to fill a wider angular region as the target thickness is increased. In addition the energy of the electrons is decreased by the ionization losses and in turn this affects the photon spectrum that is produced, in particular the intensity at the highest energies compared to the intensity at lower energies. Those photons beyond the desired angle not only are useless for such applications, they can provide deleterious effects and need to be removed.

U.S. Pat. No. 3,999,096 to Funk et al. teaches the use of a layered multi-element bremsstrahlung source using a high-Z, low-Z, high-Z layered structure. The first layer is a thick high-Z layer for bremsstrahlung production from an energetic electron beam, the second layer is a thick low-Z material for complete stopping of the electron beam, and the final layer is another high-Z material for absorbing low energy photons.

SUMMARY

Systems and methods for the production of bremsstrahlung using intense electron beams with high areal density that maximize the yield of photons in a narrow cone in the forward direction while minimizing the yield of photons at large angles have been developed. The systems and methods may offer benefit in non-intrusive active interrogation applications, such as EZ-3D and NRF technologies. See U.S. Pat. No. 5,420,905, "Detection Of Explosives And Other Materials Using Resonance Fluorescence, Resonance Absorption, And Other Electromagnetic Processes With Bremsstrahlung Radiation"; U.S. Pat. No. 5,115,459, "Explosives Detection Using Resonance Fluorescence Of Bremsstrahlung Radiation"; U.S. Published Patent Application 2007-0019788-A1, "Methods And Systems For Determining The Average Atomic Number And Mass Of Materials"; U.S. Pat. No. 7,120,226, "Adaptive Scanning Of Materials Using Nuclear Resonance Fluorescence Imaging"; U.S. Published Patent Application 2006-0188060-A1, "Use Of Nearly Monochromatic And Tunable Photon Sources With Nuclear Resonance Fluorescence In Non-Intrusive Inspection Of Containers For Material Detection And Imaging"; and U.S. patent application Ser. No. 11/557,245, "Methods And Systems For Active Non-Intrusive Inspection And Verification Of Cargo And Goods." The systems and methods may provide signals for measuring the location of the electron beam and total beam current at greatly reduced total and areal density of power compared to those of the original beam. The systems and methods may also reduce the volume of shielding material required and concomitant costs while increasing the intensity of the desired photon beam.

Figure 4:
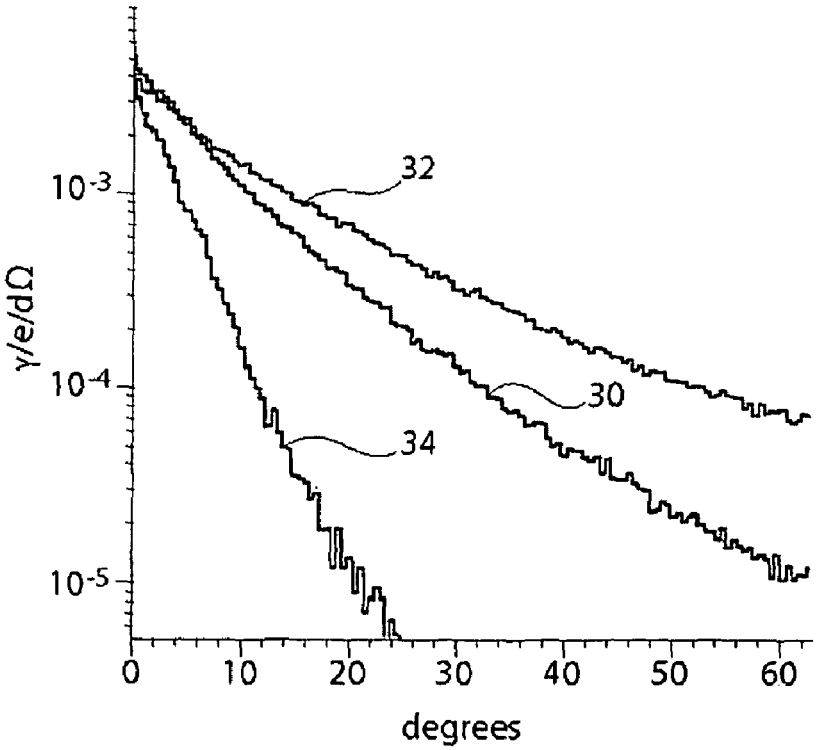

FIG. 4 shows the photon flux angular distribution to 60 degrees for: a nominal radiator with a tube having a diameter of 5 cm full of water; a copper radiator having a thickness of 1.5 cm and backed by 5 cm water; and the nominal radiator without water.

Figure 5:
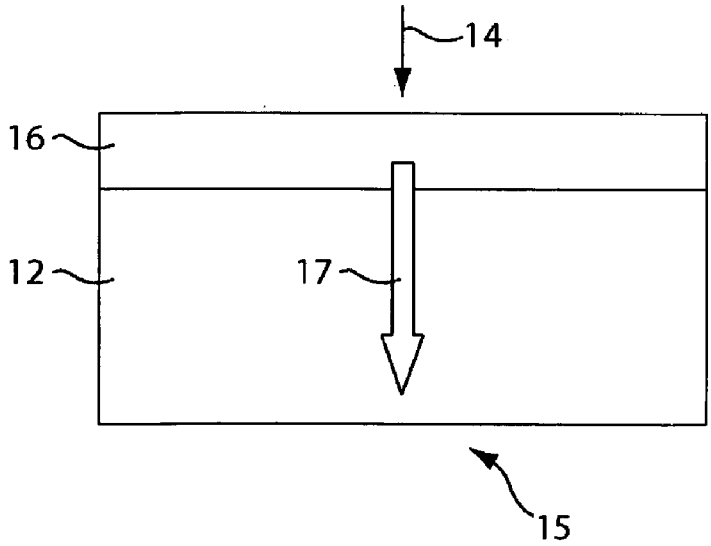

FIG. 5 shows a schematic section of thin layers of gold and titanium for one embodiment of a nominal target, with heat flow.

Figure 6A:
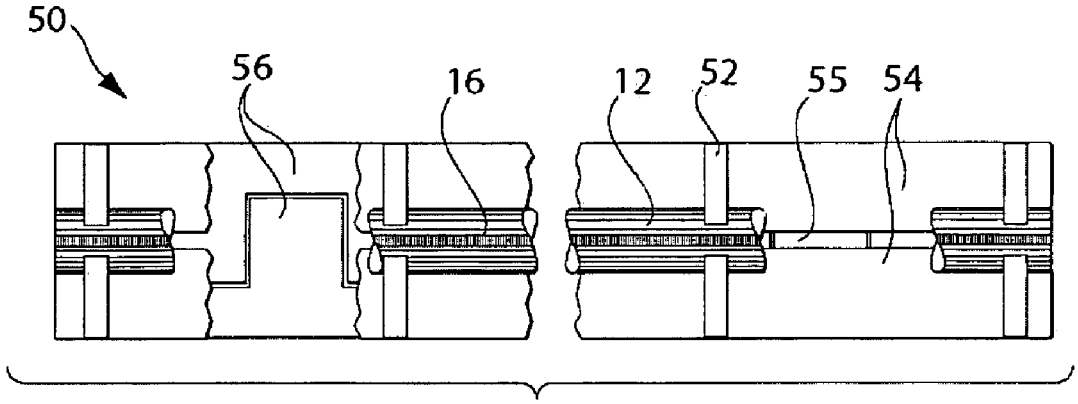
Figure 6B:
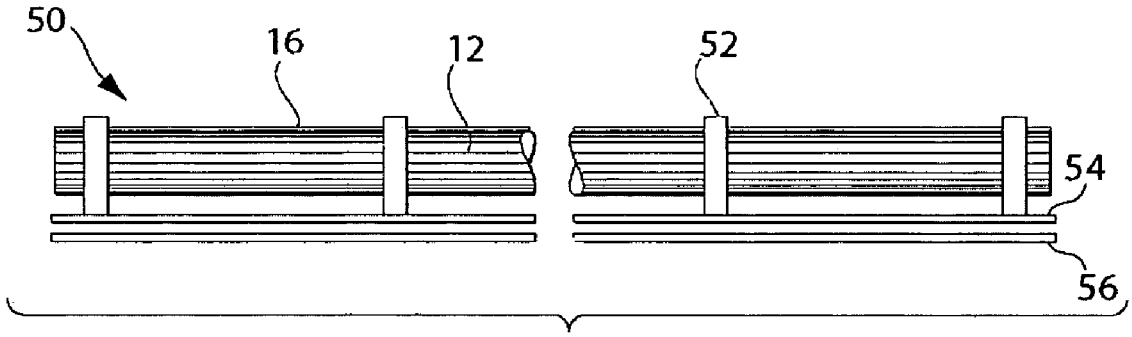
Figure 6C:
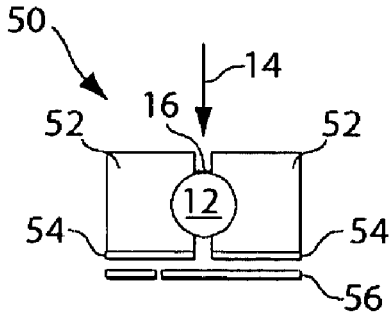

FIGS. 6A-6C show a top, a side and a front view, respectively, of an embodiment of a beam position monitor.

Figure 7:
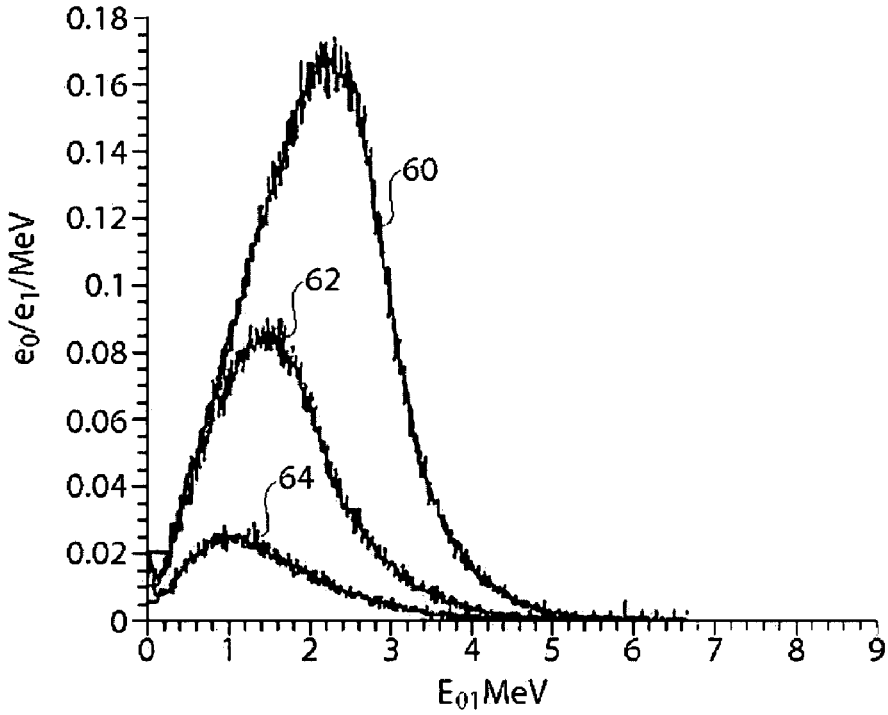

FIG. 7 is a graphical representation of the distribution of the electron beam in energy exiting from a titanium tube filled with water, for tube diameters of 4 cm, 4.5 cm, and 5 cm., for 10 MeV beam energy.

Figure 8:
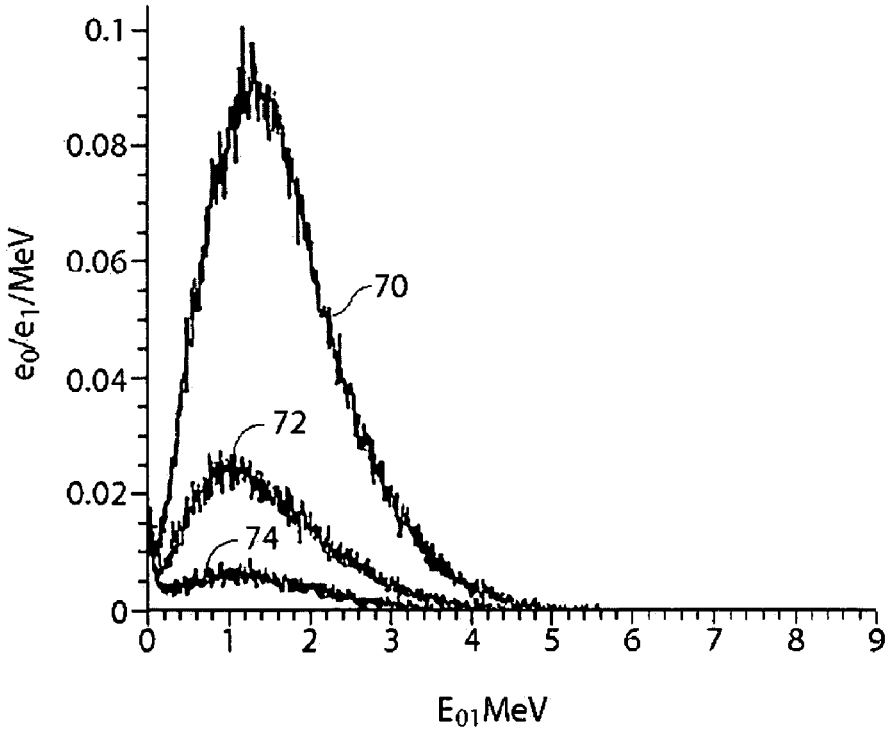

FIG. 8 is a graphical representation of the distribution of the electron beam in energy exiting from a titanium tube filled with water, for tube diameters of 4 cm, 4.5 cm, and 5 cm, for 9 MeV beam energy.

Figure 9:
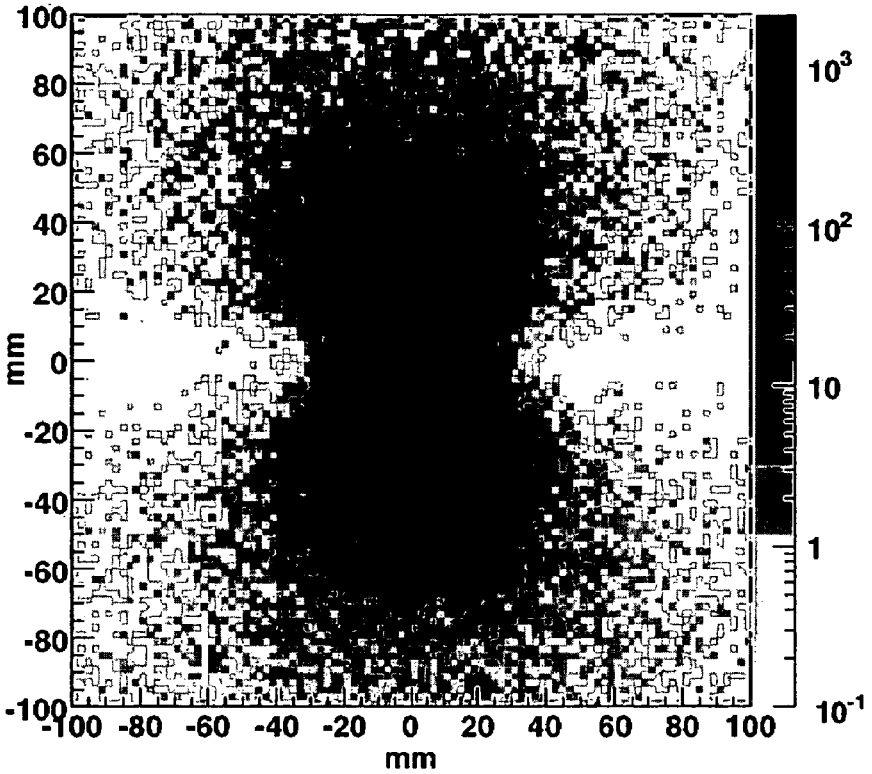

FIG. 9 shows an electron beam spatial distribution for electrons exiting the titanium tube and crossing a surface perpendicular to the original electron beam direction, for titanium tubing filled with water with a diameter of 4 cm. and 10 MeV beam energy. The direction along the axis of the tube is the horizontal axis in the figure.

Figure 10:
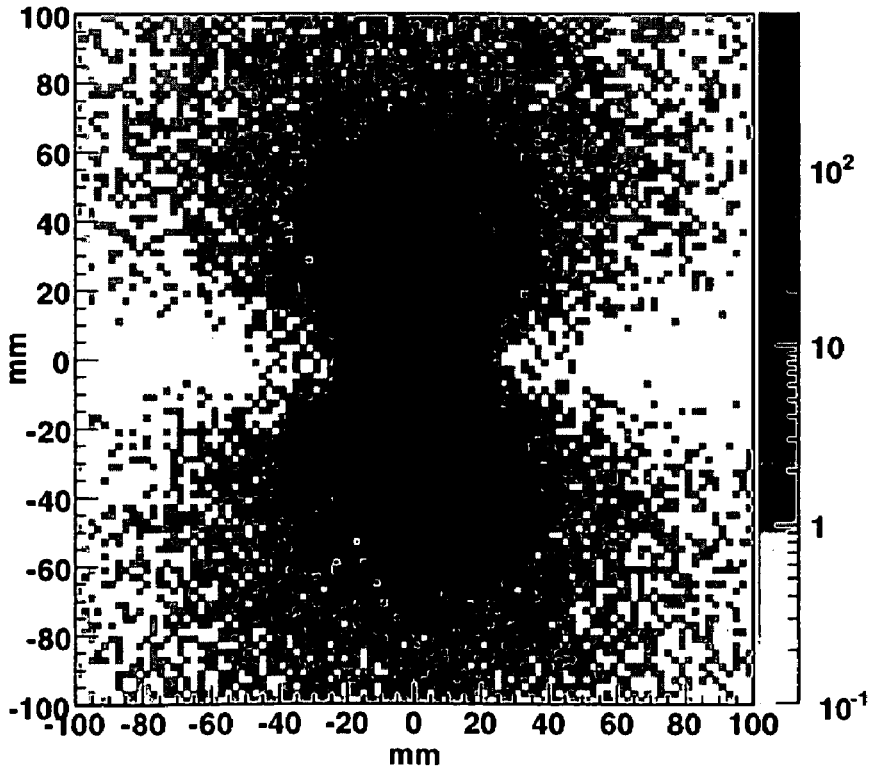

FIG. 10 shows an electron beam spatial distribution for electrons exiting the titanium tube and crossing a surface perpendicular to the original electron beam direction, for titanium tubing filled with water with a diameter of 4 cm., and 9 MeV beam energy. The direction along the axis of the tube is the horizontal axis in the figure.

Figure 11:
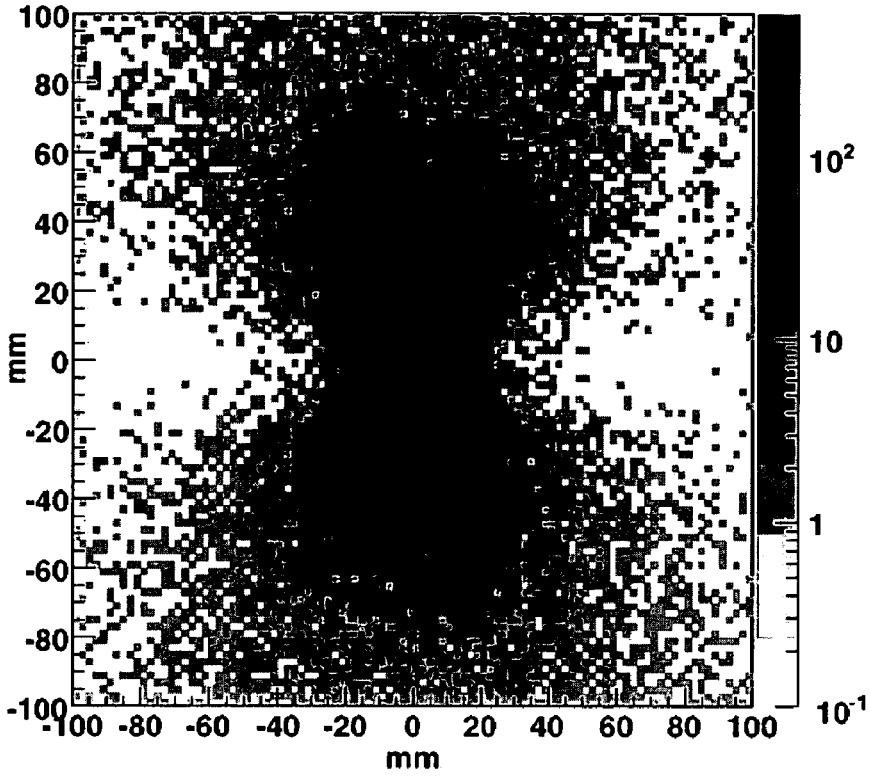

FIG. 11 shows an electron beam spatial distribution for electrons exiting the titanium tube and crossing a surface perpendicular to the original electron beam direction, for titanium tubing filled with water with a diameter of 4.5 cm. and 10 MeV beam energy. The direction along the axis of the tube is the horizontal axis in the figure.

Figure 12:
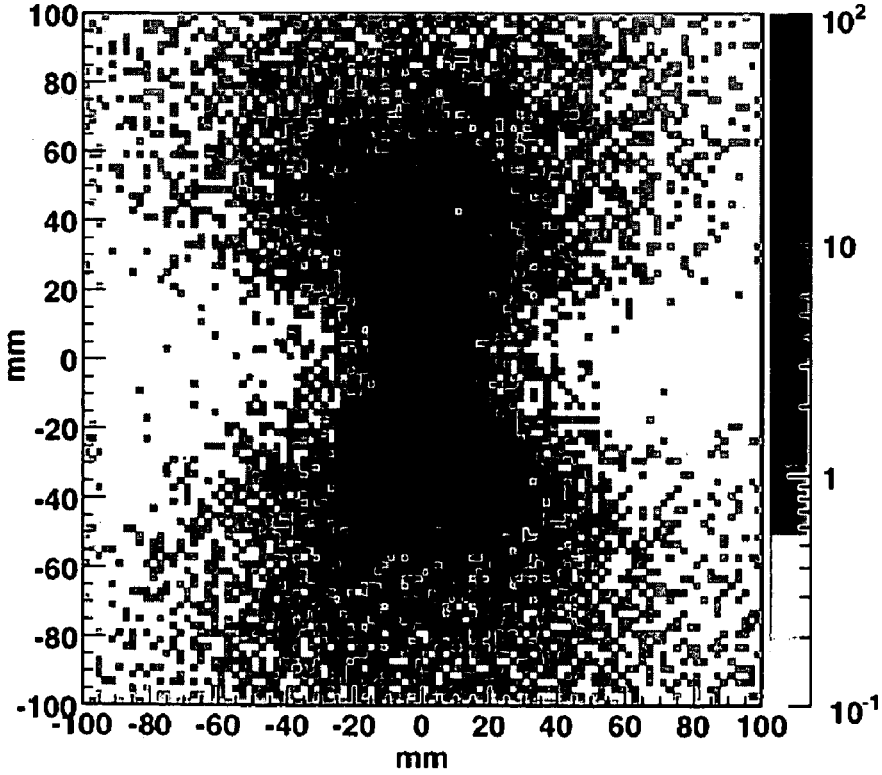

FIG. 12 shows an electron beam spatial distribution for electrons exiting the titanium tube and crossing a surface perpendicular to the original electron beam direction, for titanium tubing filled with water with a diameter of 4.5 cm. and 9 MeV beam energy. The direction along the axis of the tube is the horizontal axis in the figure.

Figure 13:
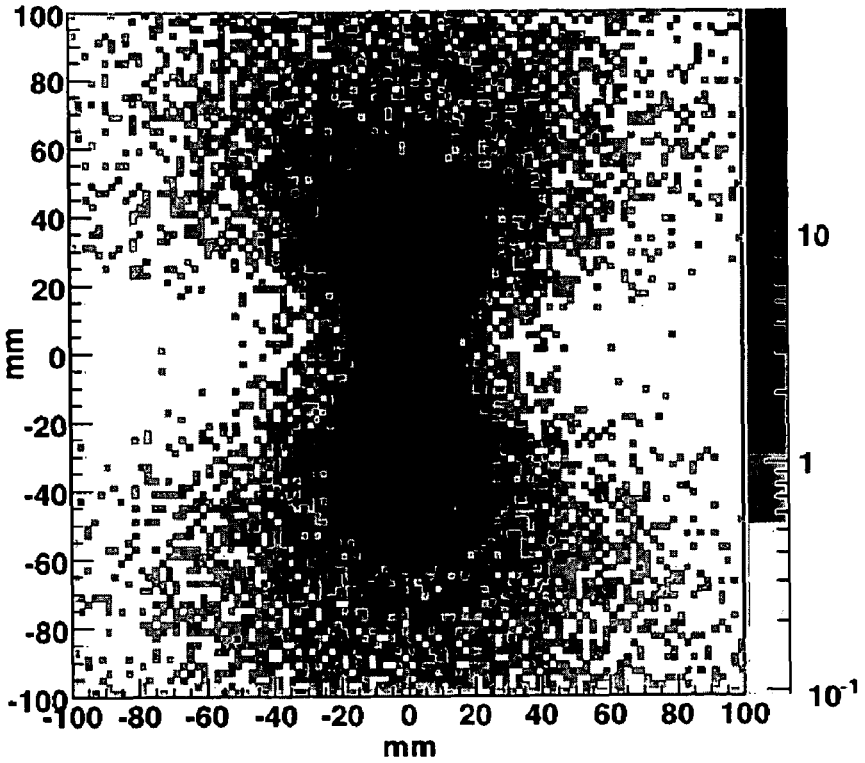

FIG. 13 shows an electron beam spatial distribution for electrons exiting the titanium tube and crossing a surface perpendicular to the original electron beam direction, for titanium tubing filled with water with a diameter of 5.0 cm. and 10 MeV beam energy. The direction along the axis of the tube is the horizontal axis in the figure.

Figure 14:
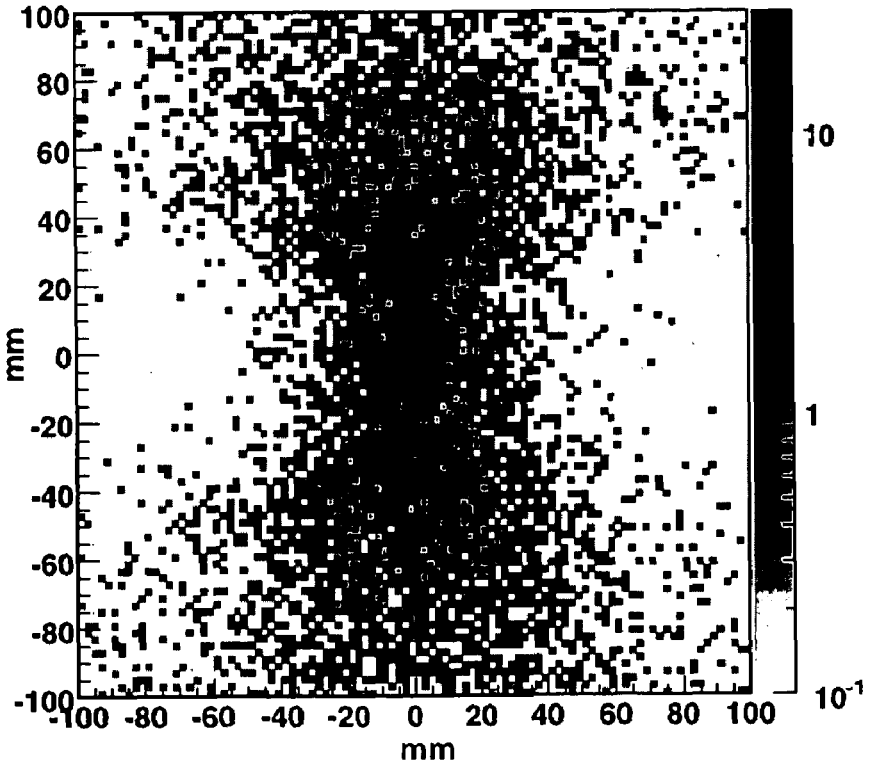

FIG. 14 shows an electron beam spatial distribution for electrons exiting the titanium tube and crossing a surface perpendicular to the original electron beam direction, for titanium tubing filled with water with a diameter of 5.0 cm. and 9 MeV beam energy. The direction along the axis of the tube is the horizontal axis in the figure.

DETAILED DESCRIPTION OF EXEMPLARY EMBODIMENTS

As discussed above, it may be desired to use a bremsstrahlung beam confined to a narrow cone in order to define a small region of space to be irradiated, and the intensity of the beam may be desired to be approximately uniform over the narrow aperture of the cone. In this circumstance, radiation outside the cone may not be useful, and indeed may be disadvantageous. In such situations the use of thin bremsstrahlung targets may be advantageous. The systems and methods disclosed herein are an improvement over the prior art (as for example in U.S. Pat. No. 3,999,096 to Funk et al.), in that by using a thin layer for bremsstrahlung production, the intensity of the narrow, central bremsstrahlung beam is greater and the intensity of the broader, scattered bremsstrahlung beam is reduced compared to prior systems and methods that use thicker layers for bremsstrahlung production.

Figure 1A:
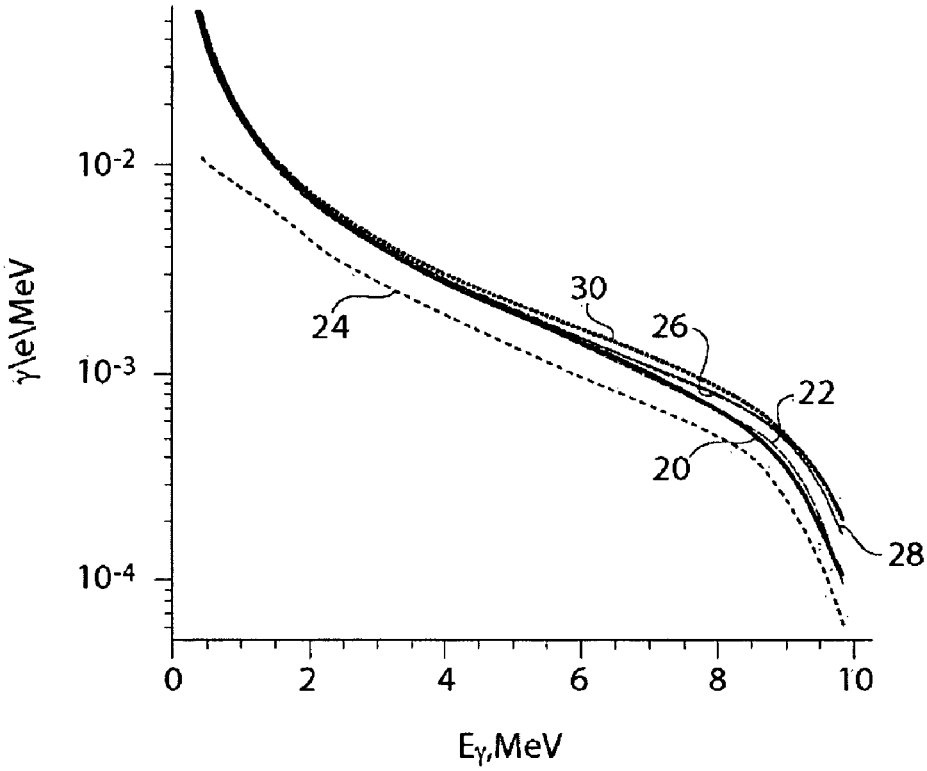
FIGS. 1A and 1B illustrate a comparison of flux in an angular aperture of 1.8 degrees for various radiators followed by 5 cm of water.
Figure 1B:
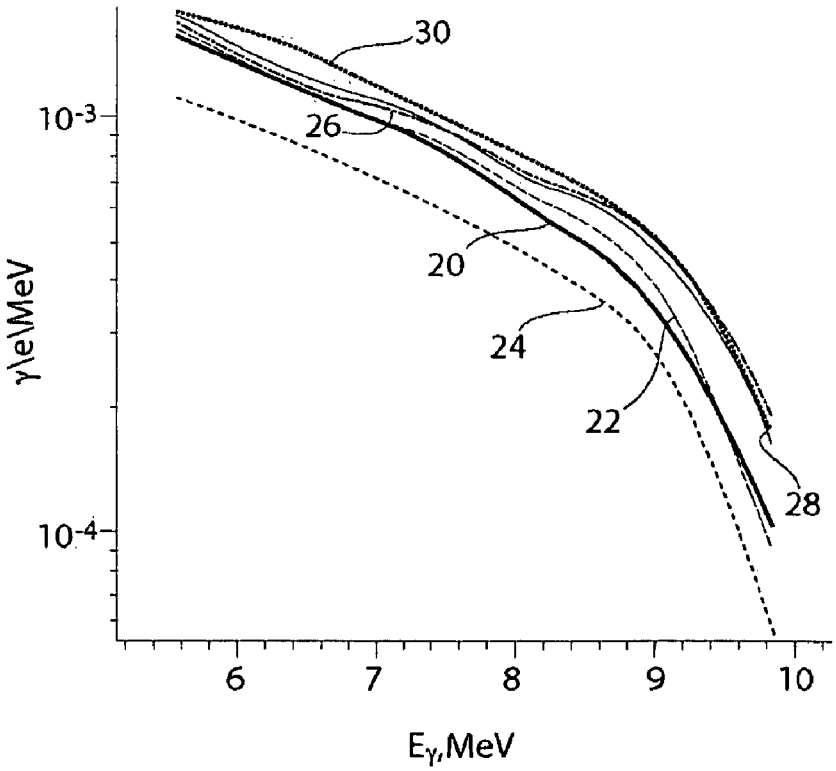

FIGS. 1A and 1B display bremsstrahlung spectra for three different thicknesses of gold layers plated on a 0.0252 cm thick supporting titanium wall, compared to the yields from three different thicknesses of copper. FIG. 1A is for photon energy from 0 to 10 MeV, the entire spectrum, while FIG. 1B is for energy from approximately 6 MeV to 10 MeV, the bremsstrahlung endpoint. The spectra are for the photons included in a cone of 1.8 degrees half angle relative to the electron beam, and are calculated using the code GEANT (Geant4 Developments and Applications, J. Allison et al., IEEE Transactions on Nuclear Science 53 No. 1 (2006) 270-278; Geant4—A Simulation Toolkit, S. Agostinelli et al., Nuclear Instruments and Methods A 506 (2003) 250-303). The statistical uncertainties of the Monte Carlo process are not shown because they are not significant for these purposes. The electron kinetic energy is 10 MeV.

In particular, curve 20 shown in FIGS. 1A and 1B illustrates bremsstrahlung spectra resulting from use of a 0.018 cm thick copper radiator, curve 22 illustrates spectra resulting from use of a 0.036 cm thick copper radiator, and curve 24 illustrates spectra resulting from use of a 1.8 cm thick copper radiator. Curve 26 illustrates spectra resulting from use of a 0.003 cm thick gold radiator layer on the titanium wall, curve 28 illustrates spectra resulting from use of a 0.0045 cm thick gold radiator layer on the titanium wall, and curve 30 illustrates spectra resulting from use of a 0.006 cm thick gold radiator layer on the titanium wall.

At all energies, the photon flux in the cone of 1.8 degrees is near saturation for the case of the 0.0252 cm titanium-wall tube plated with a layer of 0.003 cm of gold. This target produces more photons than any of the copper targets and in particular has approximately a factor of two greater yield that the target of 1.8 cm copper. The increased photon yield of the gold/titanium target over copper, in particular at the higher energies, is due to the $Z^2$ dependence of the bremsstrahlung cross section favoring gold and the self attenuation of photons in the thick copper target. The multiple scattering from copper has approximately saturated the yield in the cone of 1.8 degrees even at the thinnest copper target. In all cases the targets are backed up by approximately 5 cm of water to stop the electron beam. The water has a significant effect on the yields and multiple scattering; this is discussed hereinafter.

With all the targets used in generating FIGS. 1A and 1B, the electron energy is not depleted significantly in the gold/titanium or in the copper targets (except for the 1.8 cm thick copper target). The total energy radiated increases with increased target thickness; however, most of the increase is contained in angles larger than 1.8 degrees and thus is not useful and has to be absorbed by radiation shields. In all cases considered in FIGS. 1A and 1B the metal target (copper or gold/titanium) was followed by 5 cm of water, which stops the electrons in the case of the thin targets.

The approach used herein is to make a thin bremsstrahlung target using a high-Z radiator material (preferably Z>70) to benefit from the $Z^2$ dependence of the bremsstrahlung cross section within the natural angle. The yield within the cone of interest may be saturated because of the effects of multiple scattering. The high-Z material is supported physically by a low-Z (preferably Z<31) material, which has a lower intrinsic probability of producing bremsstrahlung to limit radiation at angles outside the cone of interest. The choice of materials may also be influenced by other requirements such as the ability to withstand high temperatures without melting and to withstand the forces from the flow of fluids that might be used as coolants, for example. One emphasis of the designs herein is to increase or maximize the radiation in a narrow cone and reduce or minimize the unwanted radiation at larger angles. Engineering practicality may, in some circumstances, inhibit the use of the high-Z material. In this case the tube may be used alone with the concomitant decrease of radiation intensity within the narrow cone desired. However, all the other advantages mentioned herein, such as the reduced radiation intensity at large angles and the continuous use of high beam power, remain in effect.

The designs herein also may permit the energy of the unwanted portion of the electron beam to be absorbed by a material that produces less radiation at the larger angles outside the cone of interest. Ideally, the unused energy of the electron beam (which is nearly all the energy after passing through the thin part of the bremsstrahlung target such as the gold and titanium in this example) would be transported to another region of space (such as by magnetic or electric transport elements) where its energy could be absorbed innocuously. In most situations this is either impractical or impossible and systems and methods set forth herein are the preferred choice.

Each situation faced by an application will have choices according to the specific requirements and there is no unique solution for all cases. However, those skilled in the art will recognize the various engineering compromises that are possible and these are all contained within the scope hereof.

Embodiments of systems and methods using thin walled tubing as the main radiator with a cooling fluid passing through the tube at high velocities are presented. The systems and methods may find use in applications where an electron beam passing through a thin radiator and coolant cannot be removed by deflection and transport via magnetic and electric elements.

Embodiments of the systems and methods disclosed herein may be used in the field of non-intrusive inspection. The capabilities of the systems and methods may allow maximum radiation intensities on a continuous basis and reduce the size and cost of shielding against unwanted radiation.

The designs of the systems may also allow a measurement of the location of the beam and measurement of the total beam current at high power levels and at greatly reduced power levels.

Unless otherwise specified, the illustrated embodiments described herein may be understood as providing exemplary features of varying detail, and therefore, unless otherwise specified, features, components, modules, and/or aspects of the illustrations can be otherwise combined, specified, interchanged, and/or rearranged without departing from the disclosed devices or methods. Additionally, the shapes and sizes of components are also exemplary, and unless otherwise specified, can be altered without affecting the disclosed devices or methods.

Figure 2A:
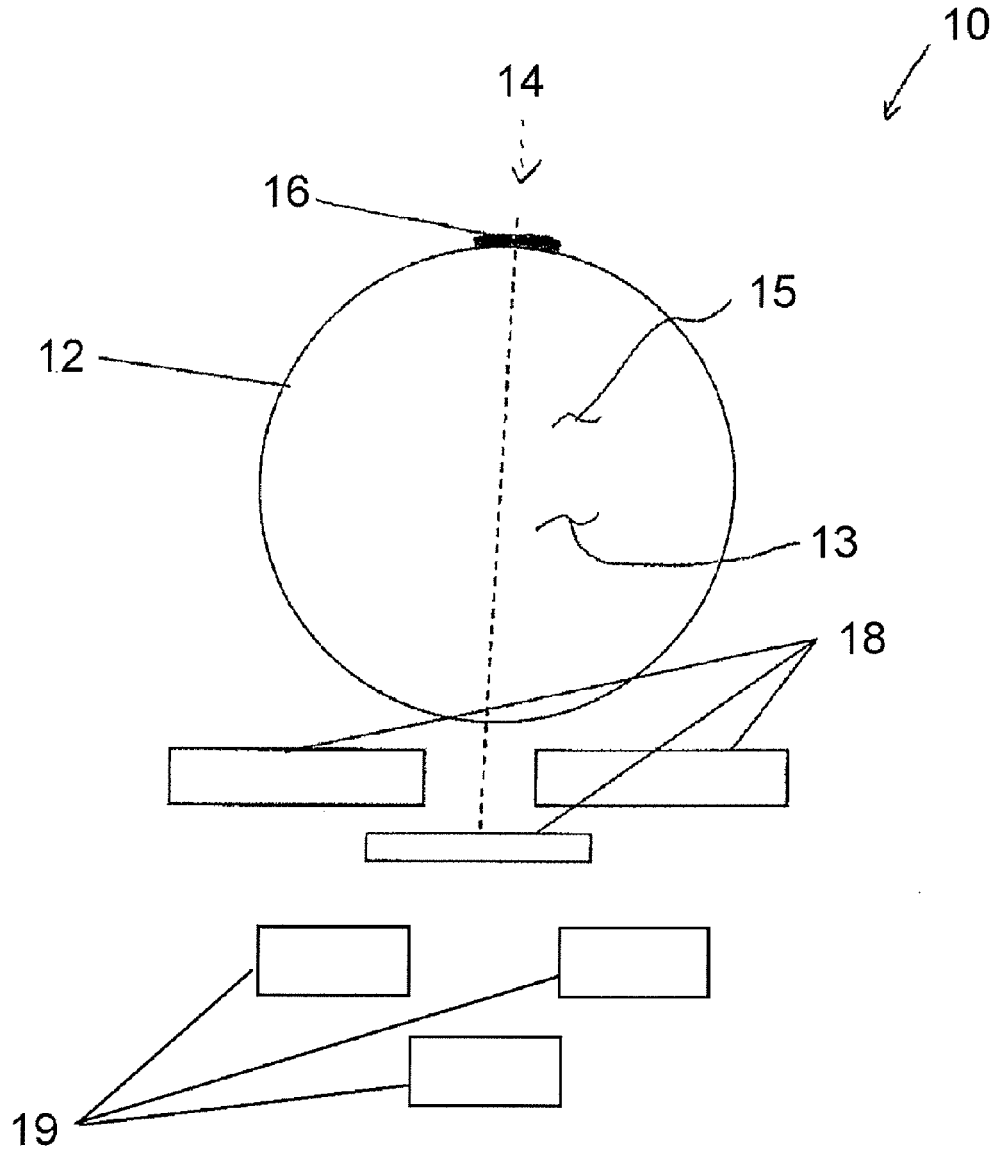
FIGS. 2A, 2B, 2C and 2D illustrate schematics of layouts of alternative embodiments of a radiator, showing respectively embodiments with tubes of circular, oval (long axis vertical), oval (long axis horizontal) and rectangular cross-sections.

FIG. 2A shows a schematic diagram of one embodiment, a bremsstrahlung source 10 having a low-Z (preferably titanium) supporting tube 12, with a high-Z (preferably gold or a higher Z material) radiator layer (which may be in the form of a strip) 16 partially coated along the length of the supporting tube 12. The supporting tube 12 is oriented such that an electron beam 14 impinges on the radiator layer 16 and the supporting tube 12 along a diameter of the supporting tube, although off-diameter geometry may also be used. A plurality of beam position sensing electrodes (pick-ups) 18 is shown.

The supporting tube 12 can be made of variety of materials such as but not limited to titanium, aluminum, vanadium, and steel, or other materials with Z<31. A person of ordinary skill in the art will know other suitable materials.

Figure 2B:
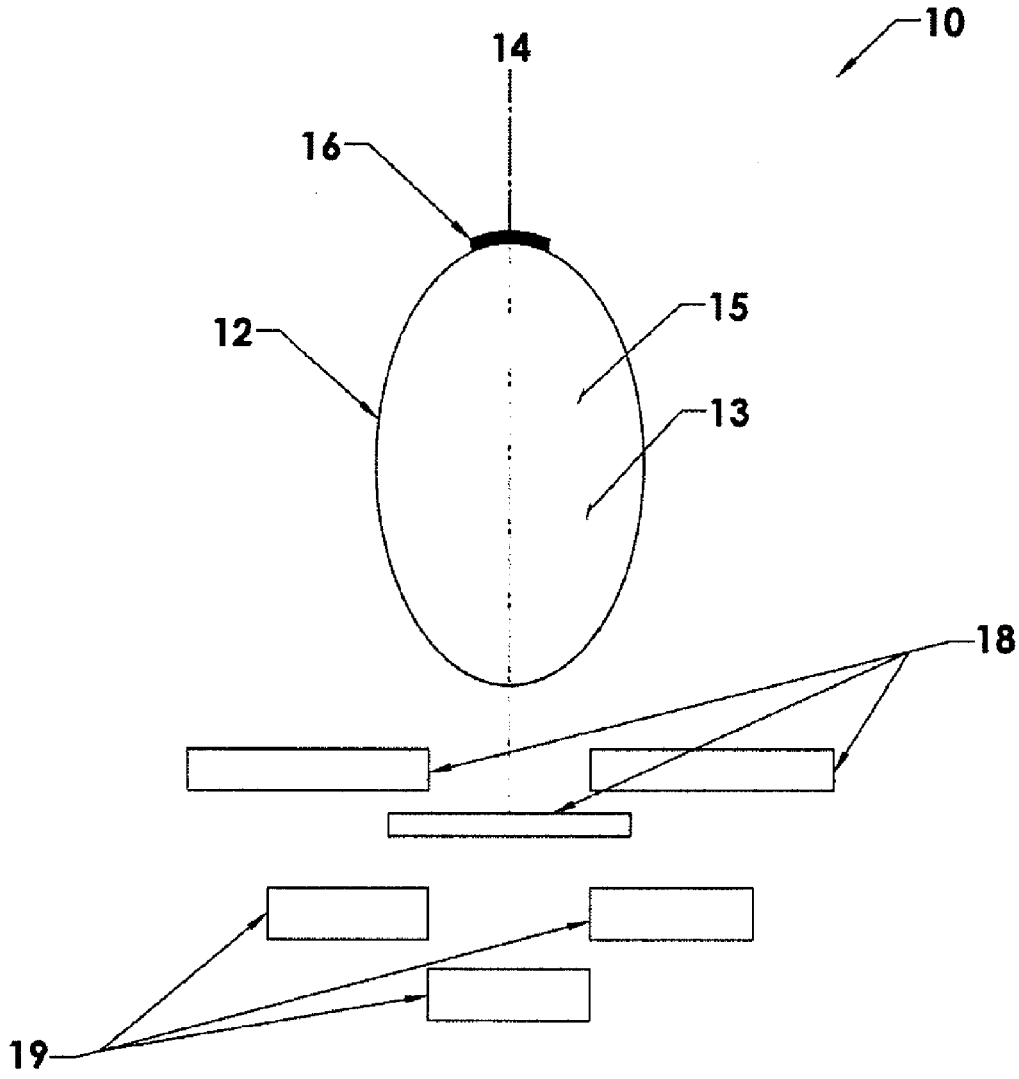
Figure 2C:
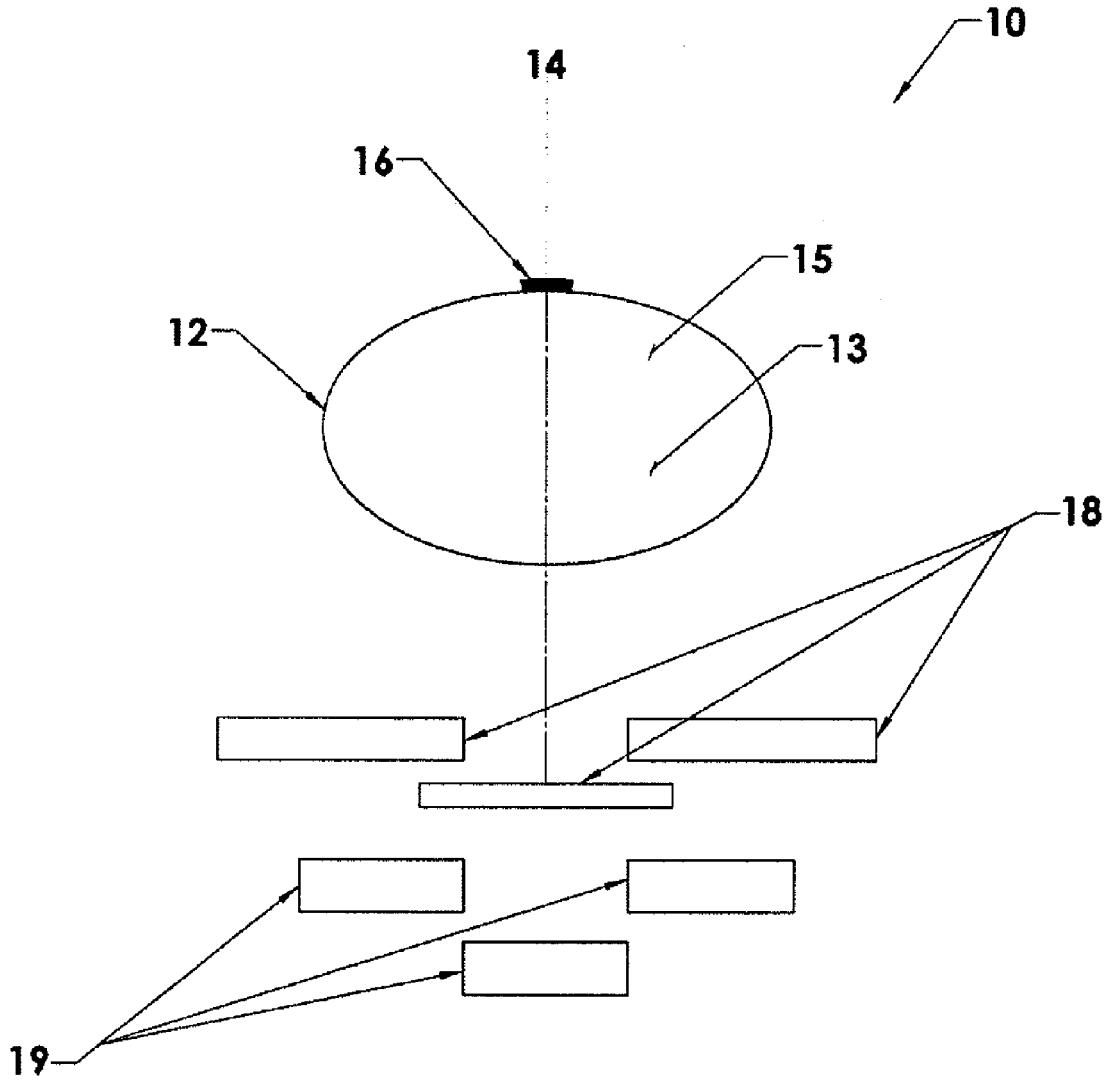
Figure 2D:
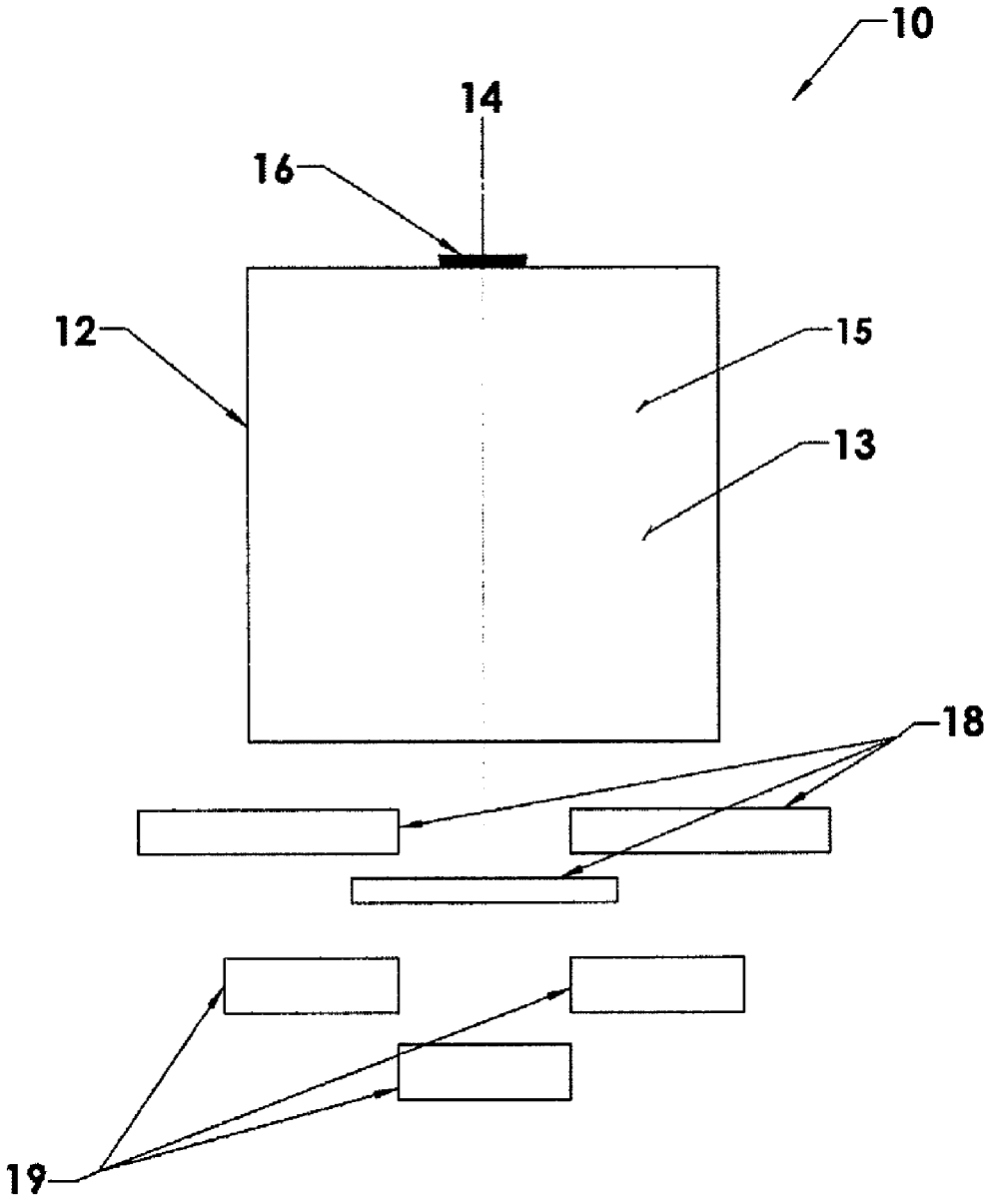

The diameter of the supporting tube 12 may depend on the electron beam energy and may be 5 cm for an electron beam of 10 MeV energy. Other diameters, including but not limited to those in a range of about 4 cm. to about 6 cm., may be used, and the diameter may be chosen for a specific application based upon the principles set forth herein and known to a person of skill in the art. In particular, insofar as circulating fluid in the supporting tube is to be used for cooling purposes, as discussed hereinbelow, the diameter of the tube must be sufficient to permit a flow of fluid sufficient to remove energy deposited by the electron beam without an unacceptable rise in the temperature of the radiator layer and supporting tube wall. (As also discussed below, the velocity of the fluid must be sufficient to guarantee turbulent flow such that, given an appropriately high pressure, boiling and vapor formation of the layer of fluid at the tube inner wall surface where the beam enters will be suppressed,) In addition, the tube must be of sufficient size to provide support for the radiator layer. Larger diameter tubes also can be used, but the diameter should not be so large that the flux of photons impinging on the downstream target is limited by absorption in the fluid. The tube in FIG. 2A is shown as circular, but other cross-sectional shapes such as but not limited to oval or rectangular may be useful. FIGS. 2B, 2C and 2D, respectively, illustrate embodiments wherein the tube is of oval (long axis vertical), oval (long axis horizontal) and rectangular cross-section.

The thickness of the titanium or other tube material may be 0.0252 cm. but other thicknesses may be used, and the thickness may be chosen for a specific application based upon the principles set forth herein and known to a person of skill in the art.

The (preferably gold) radiator layer 16 may be replaced by other materials with high-Z such as, but not limited to, platinum, tantalum or tungsten or other materials with Z>70. A person of ordinary skill in the art will know other suitable materials. The radiator layer 16 may be about 1 cm. in width, but other widths may be used depending upon the requirements of the application. The radiator layer 16 may be rectangular, square or circular, or other shapes may be used for particular geometries or applications. The radiator layer may run along the entire length of the supporting tube 12 continuously or multiple separate radiator layers may run along the length of the supporting tube with space between the separate radiator layers, or other configurations may be used depending upon the application. The thickness of the radiator layer may be 0.003 cm., but other thicknesses may be used in other applications and/or for materials other than gold. Considerations governing the radiator layer thickness are discussed below. The use of multiple separate radiation layers in different locations on the supporting tube may allow different positions to be used to generate the bremsstrahlung.

A fluid 15 (preferably water) may flow inside 13 the supporting tube 12 to conduct heat from the spot where the electron beam 14 impinges on the radiator layer 16 and to absorb most of the remaining energy from the electron beam 14 after it passes through the radiator layer 16 and the supporting tubing 12. Other fluids or mixtures thereof (including mixtures with water), preferably with an effective Z comparable to or less that that of water, may be used in place of water. The choice of fluid may be determined by engineering practicality and the ability of the fluid to absorb the remaining beam energy while minimizing the radiation from the fluid at large angles.

Other embodiments may use different regions along the supporting tube length as targets as well as different electron beam areal sizes.

Figure 3:
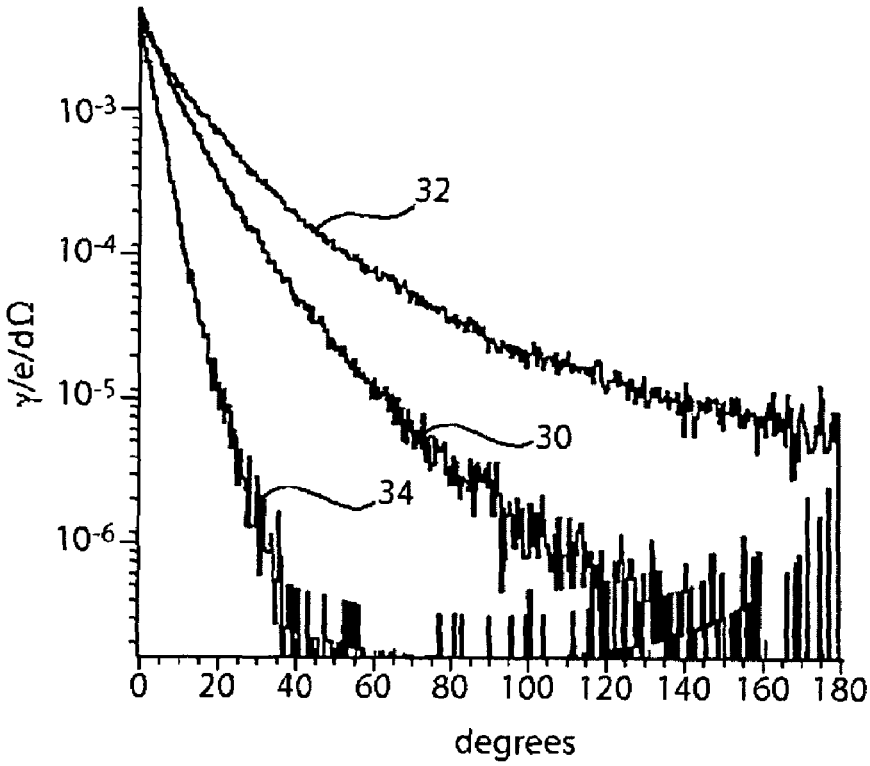
FIG. 3 shows the photon flux angular distribution to 180 degrees for: a nominal radiator (0.003 cm of gold and 0.025 cm of titanium) with a tube having a diameter of 5 cm full of water; a copper radiator having a thickness of 1.5 cm and backed by 5 cm water; and the nominal radiator without water.

The flowing fluid 15 may absorb most of the electron energy via ionization. The fluid may be water with a maximum Z of 8 resulting from its oxygen component. Electrons (of 10 MeV for example) penetrate the supporting tubing 12 and fluid 15 to form an expanded plume via scattering in the supporting tube 12 wall and the fluid 15 of considerably greater dimensions transverse to the original beam direction. This plume of electrons can be collected on beam position sensing electrodes 18 to provide a charge signal for beam position on the target at low power density compared to that of the incident beam, yet utilizing a considerable fraction of the electron beam 14 current. Alternatively, the tubing diameter may be larger and completely stop the electron beam 14. In this case the beam position and current may be monitored by detection of the bremsstrahlung radiation pattern available after the supporting tube. This radiation pattern is also peaked at the location of the electron beam as shown in FIG. 3 and FIG. 4. The bremsstrahlung radiation detectors may be ion chambers 19 appropriately designed and segmented in a manner similar to the design of the beam position sensing electrodes. Such an arrangement will be appropriate when using one tube to accommodate, for example, multiple beam energies. This embodiment is intended for high beam intensities but may be useful for low intensities as well. Persons of skill in the art will be familiar with other methods of monitoring beam intensity and position that may be used.

In FIG. 3 and FIG. 4, photon flux angular distributions for three cases are shown: (1) curve 30 represents the photon flux angular distribution for the nominal radiator discussed above with a 5 cm diameter supporting tube filled with water; (2) curve 34 represents the photon flux angular distribution for the nominal radiator without water; and (3) curve 32 represents the photon flux angular distribution using a copper radiator having a thickness of 1.5 cm backed by 5 cm of water. It is clear that the intensity in the electron beam direction (zero degrees) is not greatly changed while the addition of water broadens the angular distribution for the nominal radiator. The copper target shows a spread over a greater angular region. In all cases the electron beam kinetic energy is 10 MeV and the beam is uniformly spread out over a circle having a diameter of 1 cm.

The intensity near zero degrees remains highest for the gold and titanium combination with water in the titanium tube. Unfortunately, for high power densities the water may be necessary to carry away the beam energy, although it serves little purpose in producing radiation within the narrow cone of 1.8 degrees half angle relative to the electron beam. The beams contemplated in this embodiment may reach powers in the beam of approximately 40 kW with areal densities of 40 kW/cm$^2$ and with approximately 1 kW deposited in the gold and titanium foils in an area of 1 cm$^2$. Higher and lower powers can also be accommodated safely.

With water as the cooling fluid that absorbs most of the electron energy, the radiation at large angles may be substantially reduced compared to that using copper as the stopping medium while maintaining a high flux at zero degrees. Additionally, if a cooling fluid other than water is used, with a maximum Z less than that of oxygen, the radiation at large angles may be reduced even further.

The general practicality of the concepts disclosed herein may depend on the ability of the radiator system to manage high beam intensities and high areal densities. Towards this end the amount of energy deposited in the foils may be removed by the flow of the water or other fluid without an excessive temperature rise. It may be important to demonstrate that this energy can be removed by the water or other fluid flowing at speeds that invoke turbulent flow. In addition, at these flow rates pressures may prevent a film of vapor from developing and inhibiting the conduction of energy from the foil to the water or other fluid. Finally, the titanium (or other material) supporting tube must be capable of withstanding the hydrostatic pressures involved.

FIG. 5 shows a schematic section of a thin layer of gold on the wall of a titanium tube for one embodiment of a nominal target according to the disclosure herein. It is assumed (for example, and not by way of limitation) that the electron beam 14 has a cross sectional area of 1 cm$^2$, and a current of 4 mA, and that the beam kinetic energy is 10 MeV. The heat generated in the metals may be associated with the layers shown in FIG. 5, where the curvature of the tubing is neglected. The electron beam 14 deposits energy in the metals 16 (gold) and 12 (titanium) and the energy may flow to the water 15 by the established temperature gradient in the metal. The arrow 17 illustrates the direction of the heat flow.

The energy loss in each material due to the ionization caused by the electron beam may be calculated by using the following equation and constants. The thermal conductivity C of titanium is 22 W/m/° K. and that of gold is 320 W/m/° K. The melting point for titanium is 1668° C. and for gold is 1064° C. The specific energy loss at 10 MeV for titanium is approximately 1.61 MeV/g/cm$^2$ and that for gold is approximately 1.4 MeV/g/cm$^2$ (These data are estimated from Particle Data Handbook of the American Physical Society.) The density of gold is 19.3 g/cm$^3$ and that of titanium is 4.51 g/cm$^3$ $$\text{The energy per second deposited in a material} = (\text{density})\cdot(\text{thickness})\cdot\left(\frac{dE}{dx}\right)\cdot(\text{current}),$$

where $\frac{dE}{dx}$ represents the specific energy loss.

In one embodiment, the thicknesses of the gold plate and the titanium tubing are 0.003 cm and 0.0252 cm, respectively.

The energy loss for the gold is $(19.3\ \text{g/cm}^3)\times(3\times10^{-3}\ \text{cm})\times(1.4\times10^6\ \text{eV/g/cm}^2)\times(4\times10^{-3}\text{A})=324$ J/s The energy loss for the titanium is $(4.51\ \text{g/cm}^3)\times(2.52\times10^{-2}\ \text{cm})\times(1.61\times10^6\ \text{eV/g/cm}^2)\times(4\times10^{-3}\ \text{A})=731$ J/s.

The total power that must flow into the water from the titanium thus is 1055 J/s.

These energies may be deposited by the beam uniformly over the thickness of the foils. It is assumed that the power is uniform over the area of the beam. No account is made for the energy spreading out by conduction parallel to the foil surfaces because the foils are very thin.

The following heat equations relate the energy flow past a surface to the temperature gradient:

$$\left(\frac{dU}{dt}\right) = A\cdot C\cdot\left(\frac{dt}{dx}\right),$$

where A is the area, and C is the thermal conductivity.

$$\left(\frac{x}{th}\right)\cdot\left(\frac{dU}{dt}\right)_{tot} = A\cdot C\cdot\left(\frac{dt}{dx}\right),$$

where x is a general position in the foil and th is the foil thickness and $(dU/dt)_{tot}$ is the total energy deposited uniformly throughout the thickness of the foil.

The temperature drop across the gold thickness is calculated by using the following equation:

$$\Delta T = \left(\frac{dU}{dt}\right)_{tot} \cdot \left(\frac{1}{AC}\right) \cdot \left(\frac{1}{th}\right) \cdot \left(\frac{th^2}{2}\right).$$

Substituting appropriate values into the equation, the temperature drop across the gold thickness is equal to 0.15° C.:

$$\Delta T = (324\ \text{J/s}) \times (1/10^{-4}\ \text{m}^2) \times (1/320) \times (3 \times 10^{-5}\ \text{m}) \times (1/2) = 0.15°\ \text{C}.$$

The temperature drop across the titanium which carries its own heat to the water as well as that generated in the gold may be calculated using the following equation:

$$\Delta T = \left[\left(\frac{dU}{dt}\right)_{tot}\right]_{Au} \cdot \left(\frac{1}{AC}\right) \cdot (th) + \left[\left(\frac{dU}{dt}\right)_{tot}\right]_{Ti} \cdot \left(\frac{1}{AC}\right) \cdot \left(\frac{1}{th}\right) \cdot \left(\frac{th^2}{2}\right)$$

Substituting appropriate values into the above equation, the temperature drop across the titanium is equal to 78.4° C.:

$$\Delta T = (324\ \text{J/s}) \times (1/10^{-4}\ \text{m}^2) \times (1/22) \times (2.5 \times 10^{-4}\ \text{m}) + (731\ \text{J/s}) \times (1/10^{-4}\ \text{m}^2) \times (1/22) \times (2.5 \times 10^{-4}\ \text{m}) \times (1/2) = (324 + 731/2) \times (1/10^{-4}) \times (1/22) \times (2.5 \times 10^{-4}) = 78.4°\ \text{C}.$$

For the gold, this relation yields a very small gradient of 0.15° C. to have 324 J/s flows over an area of 1 $cm^2$ and through a thickness of 0.003 cm. The titanium must conduct the energy from the gold, 324 J/s, as well as the energy deposited in the titanium of 731 J/s. The temperature gradient in the titanium is 78.4 degrees C. Thus, the total temperature rise of the gold and titanium materials is 78.6 degrees C. That is, the temperature at the outer surface of the gold compared to the inner surface of the titanium next to the water is 78.6 degrees C.

If another high-Z material such as tantalum or tungsten is used, the temperature rise across that material may be different because of the differing thermal conductivity but the practical aspects of the application remain substantially the same. Similarly, the thermal conductivity of titanium is dependent on the alloy used and the temperature rise across that material may be different because of the differing thermal conductivity but again the practical aspects of the application remain substantially the same.

The temperature of the inner wall of the titanium may be estimated by using the concepts of turbulent flow of water and the heat removal this flow can manage. The following is a summary of the calculation based on the assumption that the titanium tube is 10 feet long and has a diameter of 4 cm. There is very little difference in this calculation between using a 4 cm or 5 cm diameter tube. The fluid properties are evaluated at the bulk water temperature of 26.7° C. (80° F.) with a hydraulic diameter calculated for a round cross section.

The titanium target in a thin wall tubular configuration is analyzed for heat transfer performance to the water and the initial conditions and results are exhibited in the following table.

The governing equation used comes from *Principles of Heat Transfer*, Frank Kreith 3rd edition, Intext Educational Publishers, 1973. The calculations were carried out in English units and the results in both SI and English units are shown in Table 1.

$$[Nu =]\left(\frac{h_c}{C_p \rho_f V_f}\right) = 0.023 \cdot \left(\frac{1}{Re}\right)^{0.2} \cdot (Pr_f)^{-2/3},$$

where $h_c$=forced convection heat transfer coefficient, $h_c$ $\rho_f$=density of the water, $C_p$=specific heat of water, $V_f$=velocity of the water, k=thermal conductivity, $D_H$=hydraulic diameter, $\mu_f$=absolute viscosity fluid, Re (Reynolds number)=$\rho_f V_f D_H/\mu_f$ Pr (Prandtl number)=$C_p \mu_f/k$ $$Q/A = h_c(T_w - T_f),$$

where

Q/A=heat flux, watts/$cm^2$ $T_w$=Wall temperature, $T_f$=fluid or water temperature, The desired heat removal flux is approximately 1 KW per $cm^2$. The case of 22.9 M/s (75 ft/s) water flow velocity yields the desired heat flux at a relatively low wall temperature of 258.7° C. (497.6° F.) at the fluid-wall interface. The temperature of the outer layer of metal (gold in this example) is approximately 337.7° C. and remains well within the safe limits of not melting.

The fast water flow of 22.9 M/s (75 f/s) results in turbulent flow and the water in any 1 cm location along the tube is replaced approximately every $4.4 \times 10^{-4}$ seconds. In this time interval the energy flux from the tubing is only 0.44 J/$cm^2$ and from the electron beam less than approximately 17 joules. The bulk temperature rise of the water is on the order of one degree and therefore it may not be of concern.

The temperature of the water in the example mentioned above can approach that of the surface of the inner wall of the titanium, 232° C. Those skilled in the art will recognize that with the fast flows of water in this example, the formation of nucleate boiling is not a danger. Nucleate boiling is a predecessor to film boiling, which prevents abundant heat transfer and leads to burnout/failure. The conditions for nucleate boiling may be estimated by using empirically derived equations (W M Rohsenow, H Choi, "Heat, Mass and Momentum Transfer" Prentice Hall, 1961 pg. 231, equation 9.26) accurate to approximately +/−16%.

TABLE 1

Heat transfer performance of the titanium target in a thin wall tubular configuration.

| Velocity M/S (Ft/S) | Bulk Temp ° C. (° F.) | Diameter Cm (ft) | Wall Temp − Bulk Temp ° C. (° F.) | Reynolds Number | Prandtl Number | Pressure Drop N/$m^2$ (psi) | Q/A, Heat flux W/cm2 |
|---|---|---|---|---|---|---|---|
| 22.9 (75) | 26.7 (80) | 4 (0.1312) | 427 (800) | 1,038,038 | 5.78 | 2.76 E5 (40) | 1952 |
| 22.9 (75) | 26.7 (80) | 4 (0.1312) | 232 (450) | 1,038,038 | 5.78 | 2.76 E5 (40) | 1000 |

The peak heat flux for fully developed boiling may be calculated by using the following derived empirical equation. Water conditions used for this calculation include the following:

water velocity: 22.9 M/s (75 ft/s);
water Bulk Temp: 26.7° C. (80° F.);
pressures: 6.9 E5 and 1.03 E6 N/M$^2$ (100 and 150 psia).

The following equation may be used to calculate the peak heat flux. (W M Rohsenow, H Choi, "Heat, Mass and Momentum Transfer" Prentice Hall, 1961 pg. 231, equation 9.26) (accurate to approximately +/−16%.)

$$q/A=480{,}000\times(1+0.0365V)\times(1+0.00508\Delta T_{sc})\times(1+0.0131P),$$

where
q/A=heat flux, BTU/ft$^2$-hr
$T_{sat}$=saturated water temp @100 or 150 psia, ° F.
$T_{bulk}$=bulk water temp, ° F.
$\Delta T_{sc}=T_{sat}-T_{bulk}$, water subcooling, F.°
V=velocity of water, ft/s,
P=Pressure of the water, psia

TABLE 2

Summary of calculations for peak heat flux for fully developed boiling.

| Water Pressure, P N/M$^2$ (psia) | T sat ° C. | T bulk ° C. | $\Delta T_{sc}$ ° C. | Water Velocity M/s (ft/s) | Heat Flux for fully developed boiling KW/cm$^2$ |
|---|---|---|---|---|---|
| 1.03 E6 (150) | 181.4 | 27 | 154.4 | 22.9 (75) | 3.6 |
| 6.9 E5 (100) | 164.4 | 27 | 137.4 | 22.9 (75) | 2.9 |

Forced convection, subcooled heat transfer may increase the peak heat flux needed for nucleate boiling. Burnout conditions (tube burn through or tube vaporization) are thus pushed to a higher threshold of power flow. From Lienhard IV, J H and Lienhard V, J H "A Heat Transfer Textbook" 3rd edition, 2006. Phlogiston Press, Cambridge, Mass. pg 496: " . . . it is worth noting that one may obtain very high cooling rates using film boiling with both forced convection and subcooling."

From the calculations above it has been established that it may be possible to deposit well over 1 kW/cm$^2$ safely in a thin bremsstrahlung target and cool it to a level wherein the materials are well below melting temperature. Those schooled in the art will recognize that different geometries are possible such as coaxial tubes and partitioned channels that may reduce the total flow rate while maintaining the velocities of flow to cool the surfaces where the beam transits through the surface of the tube.

Signals to determine the total current of the electron beam and the position of the beam on the bremsstrahlung target may be acquired. The signals may serve many purposes including determining the intensity of the radiation, monitoring the stability of the operation of the beam generation and transport of the beam to the radiator.

In FIG. 7, the energy distribution of the electron beam exiting from the titanium tube is shown for titanium tubes having diameters of 4 cm (curve 60), 4.5 cm (curve 62) and 5 cm (curve 64) for an incident electron beam energy of 10 MeV. FIG. 8 illustrates the energy distribution of the electron beam exiting from the titanium tube for titanium tubes having diameters of 4 cm (curve 70), 4.5 cm (curve 72) and 5 cm (curve 74) for an incident electron beam energy of 9 MeV. These are calculated by Monte Carlo simulation using GEANT (Geant4 Developments and Applications, J. Allison et al., Transactions on Nuclear Science 53 No. 1 (2006) 270-27).

FIGS. 9-14 exhibit the electron beam spatial distributions for electrons crossing a surface perpendicular to the original electron beam direction and located just under the water-filled titanium tubing (opposite the side where the electron beam enters the titanium tubing). FIGS. 9, 11 and 13 show distributions for titanium tubing with diameters of 4 cm, 4.5 cm, and 5.0 cm, respectively, and 10 MeV incident beam energy, and FIGS. 10, 12 and 14 show distributions for titanium tubing with diameters of 4 cm, 4.5 cm, and 5.0 cm, respectively, and 9 MeV incident beam energy.

The figures show that the electrons that exit the titanium tube may be degraded in energy and dispersed in space by a substantial amount. The result shows that there is much less energy to be absorbed as heat and the energy is much less concentrated in area which may make it feasible to derive signals on electrodes that stop the electrons without reaching densities similar to the original beam of 40 kW/cm$^2$ as used in this exemplary embodiment.

For example, the use of a 4 cm titanium tube yields at 9 MeV incident beam energy approximately 800 watts of power to be absorbed in an electrode of more than 8 cm$^2$ of surface. Those skilled in the art may recognize the great advantage this disclosure confers on the practical aspects of generating signals to monitor the total beam current and the beam position continuously anywhere along an elongated (for example, 3.048 m (10 foot) long) bremsstrahlung target. The technique may also be applicable to other lengths of bremsstrahlung target.

The almost exact symmetry of the transmitted electron beam patterns show that by collecting electron beam current on electrodes symmetrically positioned relative to the titanium tube, the electron beam position may be determined and monitored. The beam position sensing electrodes can be positioned to demand the equality of beam current that the patterns show in FIGS. 9-14. The beam position sensing electrodes can be calibrated for misalignment and errors in positioning and manufacture. By collecting all the electrons that stop in the water (are collected by the supporting tube) and in the external beam position sensing electrodes (FIGS. 2A, 2B, 2C and 2D), the total electron beam current may be determined along with beam position.

FIGS. 6A-6C show three orthogonal views of one embodiment of a beam position monitor 50. This embodiment may include a support tube 12, a tube support 52, upper plate pick-ups 54, and lower fingered pick-ups 56. The upper plate pick-ups 54 may be two elongated electrodes (preferably copper strips) parallel to and on either side of the support tube 12 on the exit side of the electron beam 14. The difference in the collected charge on these upper plate pick-ups 54 may be used to monitor the beam position with respect to a centerline of the support tube 12. Along with these upper plate pick-ups 54 and down stream from them there may be two lower fingered pick-ups or fingered arrays 56 to intercept the beam transmitted through an opening 55 between the upper plate pick-ups 54. These fingered arrays 56 may be used to monitor the beam position on either side of the nominal beam position along the length of the support tube 12.

This embodiment is exemplary only and persons skilled in the art will recognize that other configurations of electrodes are possible, and other materials may be used.

In the figures that illustrate the embodiments of the disclosure, like item designator numbers refer to like items.

The use of water as a coolant in close proximity to the electron beam may cause the generation of neutrons via the (gamma, neutron) process in the deuterium in the water. This may be reduced by more than a factor of 50 with the use of commercially available deuterium depleted water.

The bremsstrahlung source described in this embodiment may result in the ability to have an electron beam of energies approximately 10 MeV and of more than 4 mA current in a 1 $cm^2$ area incident on a thin radiator layer continuously without danger of melting or destroying the target or its support tube by overheating.

The novel design has many advantages over designs using thick metals such as copper to stop the electron beam and over designs using thick gold (or other high-z layers) supported by thick low-Z layers for stopping the electrons. The novel design may allow the system to operate continuously at one position of the electron beam without destroying the target. Another advantage may be that the intensity of the bremsstrahlung radiation in a small conical angle (for example, about +/−1.8 degrees) may be larger by approximately a factor of two compared to a copper target approximately 1.5 cm thick (or other thick target) or one that stops the electron beam. In addition, the radiation at large angles may be decreased by a substantial factor thus requiring less shielding to eliminate undesired radiation.

The radiation layer thickness for a given application may be determined by a consideration of the tradeoffs involved. In particular, if it is desired to illuminate uniformly a downstream target with the bremsstrahlung beam, the thickness of the radiator layer can be chosen appropriately. In the absence of such considerations, if a thick target were used, such as a target that stops the electron beam completely, there would be significant bremsstrahlung radiation at large angles to the electron beam. To reduce such undesirable stray bremsstrahlung radiation, the radiator layer thickness can be chosen so that, for the electron beam target material and electron beam energy being utilized, the bremsstrahlung beam has an opening half-angle sufficient to illuminate the downstream target approximately uniformly. In such a case, the beam intensity will decline sharply for larger angles, relative to the radiation from a thick target, such that stray bremsstrahlung radiation is minimized. Reductions in stray radiation of a factor of ten or one hundred or even more are desirable and may be obtained, depending on the desired geometry and energy range. For clarity, we refer herein to the desired opening half-angle for the bremsstrahlung beam as the "downstream target illuminating angle," and we refer to the thickness of the radiator layer associated with that opening angle, for a given electron target material and electron beam energy, as the "critical thickness." It should be recognized that if a radiator layer is thinner than the critical thickness, the downstream target will not be optimally illuminated by the bremsstrahlung beam, while if the radiator layer is thicker than the critical thickness, the stray radiation that does not illuminate the downstream target will be increased. Of course, in making these determinations the broadening effect of the fluid in the supporting tube and the tube itself, as discussed and illustrated above, should be taken into account as required. The energy region of interest in the bremsstrahlung spectrum also may be a consideration.

Finally, FIGS. 1A and 1B which were discussed previously demonstrate that while the yield of photons at higher photon energies (e.g., approaching 10 MeV) is very significantly enhanced by the thin gold radiator, at lower energies even a low-Z material such as copper by itself will produce substantially the same yield, without a gold or other high-Z radiator. Thus a tube made of material in the range Z<31 and of thickness of about 0.03 cm can accommodate the high beam power discussed herein and produce a competitive yield of photons in the critical angular region for the lower energy region of the photon spectrum, without the addition of a separate radiator layer.

The methods and systems disclosed herein may also make it possible to derive strong signals for accurately positioning the electron beam using electrodes that operate at low power densities and low total power compared to the original beam. The total electron beam current may be monitored by collecting the charge stopped in the water and in the electrodes without special transports or high power specialized beam "dumps."

The methods and systems disclosed herein are suitable for designs accommodating a wide range of beam energies, which stop the electron beam completely. In this case segmented radiation monitors may serve as position and intensity monitors. One example of such detectors would be ionization chambers, or other detectors known to persons of ordinary skill in the art may be used.

What is claimed is:

1. A system for generating a bremsstrahlung beam containing photons of energy of at least 1 MeV. for illuminating a downstream target, comprising:

a) an electron source, b) a radiator layer, c) one supporting tube, and d) a fluid, wherein the radiator layer is disposed directly on an exterior wall of the one supporting tube, wherein the radiator layer and the one supporting tube are positioned such that an entire cross-section of an electron beam from the electron source is incident successively upon the radiator layer and the exterior wall of the one supporting tube, wherein the radiator layer comprises a material with Z>70, wherein the supporting tube comprises a material with Z<31, wherein the fluid circulates in the supporting tube;

wherein the electron source provides an electron beam comprising electrons of energy of at least 1 MeV, wherein the radiator layer is about 0.003 cm thick, and wherein a tube interior radius is larger than a thickness of the one supporting tube exterior wall at all points on the exterior wall; and wherein a tube interior diameter is larger that a width of the radiator layer.

2. The system of claim 1, wherein the radiator layer comprises a material chosen from the group platinum, tungsten and tantalum.

3. The system of claim 1, wherein the radiator layer comprises gold.

4. A system for generating a bremsstrahlung beam containing photons of energy of at least 1 MeV. for illuminating a downstream target, comprising:

a) an electron source, b) a radiator layer, c) one supporting tube, and d) a fluid, wherein the radiator layer is disposed directly on an exterior wall of the one supporting tube, wherein the radiator layer and the one supporting tube are positioned such that an entire cross-section of an electron beam from the electron source is incident successively upon the radiator layer and the exterior wall of the one supporting tube, wherein the radiator layer comprises a material with Z>70, wherein the supporting tube comprises a material with Z<31, wherein the fluid circulates in the supporting tube;

wherein the electron source provides an electron beam comprising electrons of energy of at least 1 MeV, wherein the supporting tube comprises a material chosen from the group titanium, aluminum, vanadium and steel, and wherein a tube interior radius is larger than a thickness of the one supporting tube exterior wall at all points on the exterior wall; and wherein a tube interior diameter is larger that a width of the radiator layer.

5. The system of claim 4, wherein the supporting tube comprises titanium.

6. The system of claim 5, wherein the exterior wall of the supporting tube is about 0.0252 cm thick.

7. A system for generating a bremsstrahlung beam containing photons of energy of at least 1 MeV. for illuminating a downstream target, comprising:

a) an electron source, b) a radiator layer, c) one supporting tube, and d) a fluid, wherein the radiator layer is disposed directly on an exterior wall of the one supporting tube, wherein the radiator layer and the one supporting tube are positioned such that an entire cross-section of an electron beam from the electron source is incident successively upon the radiator layer and the exterior wall of the one supporting tube, wherein the radiator layer comprises a material with Z>70, wherein the supporting tube comprises a material with Z<31, wherein the fluid circulates in the supporting tube;

wherein the electron source provides an electron beam comprising electrons of energy of at least 1 MeV, wherein the supporting tube has a circular cross section, wherein the supporting tube has a diameter between about 4 cm and about 6 cm, and wherein a tube interior radius is larger than a thickness of the one supporting tube exterior wall at all points on the exterior wall; and wherein a tube interior diameter is larger that a width of the radiator layer.

8. The system of claim 7, wherein the fluid is water.

9. A system for generating a bremsstrahlung beam containing photons of energy of at least 1 MeV. for illuminating a downstream target, comprising:

a) an electron source, b) a radiator layer, c) one supporting tube, and d) a fluid, wherein the radiator layer is disposed directly on an exterior wall of the one supporting tube, wherein the radiator layer and the one supporting tube are positioned such that an entire cross-section of an electron beam from the electron source is incident successively upon the radiator layer and the exterior wall of the one supporting tube, wherein the radiator layer comprises a material with Z>70, wherein the supporting tube comprises a material with Z<31, wherein the fluid circulates in the supporting tube;

wherein the electron source provides an electron beam comprising electrons of energy of at least 1 MeV, wherein the supporting tube has a circular cross section, wherein the supporting tube has a diameter sufficient for the fluid and the exterior wall to stop the electron beam, and wherein the tube interior radius is larger than a thickness of the one supporting tube exterior wall at all points on the exterior wall; and wherein a tube interior diameter is larger that a width of the radiator layer.

10. A system for generating a bremsstrahlung beam containing photons of energy of at least 1 MeV. for illuminating a downstream target, comprising:

a) an electron source, b) one supporting tube, c) a radiator layer disposed directly on an exterior wall of the one supporting tube d) a fluid, and e) a beam position monitor system disposed proximate an exterior wall of the supporting tube opposite a portion of the exterior wall on which the radiator layer is disposed, wherein the radiator layer and the one supporting tube are positioned such that an entire cross-section of an electron beam from the electron source is incident successively upon the radiator layer and the exterior wall of the one supporting tube, wherein the radiator layer comprises a material with Z>70, wherein the supporting tube comprises a material with Z<31, wherein the fluid circulates in the supporting tube;

wherein the electron source provides an electron beam comprising electrons of energy of at least 1 MeV, wherein the supporting tube has a circular cross section, wherein the supporting tube has a diameter sufficient for the fluid and the exterior wall to reduce an electron beam intensity such that the beam position monitor system is enabled to monitor a position and an intensity of the electron beam, and wherein the tube interior radius is larger than a thickness of the one supporting tube exterior wall at all points on the exterior wall; and wherein a tube interior diameter is larger that a width of the radiator layer.

11. A system for generating a bremsstrahlung beam containing photons of energy of at least 1 MeV. for illuminating a downstream target, comprising:

a) an electron source, b) a radiator layer, c) one supporting tube, and d) a fluid, wherein the radiator layer is disposed directly on an exterior wall of the one supporting tube, wherein the radiator layer and the one supporting tube are positioned such that an entire cross-section of an electron beam from the electron source is incident successively upon the radiator layer and the exterior wall of the one supporting tube, wherein the radiator layer comprises a material with Z>70, wherein the supporting tube comprises a material with Z<31, wherein the fluid circulates in the supporting tube;

wherein the electron source provides an electron beam comprising electrons of energy of at least 1 MeV, wherein the supporting tube has a circular cross section, wherein the radiator layer and the supporting tube are positioned such that the electron beam from the electron source is incident successively upon the radiator layer and the exterior wall of the supporting tube along the diameter of the supporting tube, and wherein a tube interior radius is larger than a thickness of the one supporting tube exterior wall at all points on the exterior wall; and wherein a tube interior diameter is larger that a width of the radiator layer.

12. A system for generating a bremsstrahlung beam containing photons of energy of at least 1 MeV. for illuminating a downstream target, comprising:

a) an electron source, b) a radiator layer, c) one supporting tube, and d) a fluid, wherein the radiator layer is disposed directly on an exterior wall of the one supporting tube, wherein the radiator layer and the one supporting tube are positioned such that an entire cross-section of an electron beam from the electron source is incident successively upon the radiator layer and the exterior wall of the one supporting tube, wherein the radiator layer comprises a material with Z>70, wherein the supporting tube comprises a material with Z<31, wherein the fluid circulates in the supporting tube;

wherein the electron source provides an electron beam comprising electrons of energy of at least 1 MeV, wherein the supporting tube has an oval cross section, and wherein a tube interior radius is larger than a thickness of the one supporting tube exterior wall at all points on the exterior wall; and wherein a tube interior diameter is larger that a width of the radiator layer.

13. A system for generating a bremsstrahlung beam containing photons of energy of at least 1 MeV. for illuminating a downstream target, comprising:

a) an electron source, b) a radiator layer, c) one supporting tube, and d) a fluid, wherein the radiator layer is disposed directly on an exterior wall of the one supporting tube, wherein the radiator layer and the one supporting tube are positioned such that an entire cross-section of an electron beam from the electron source is incident successively upon the radiator layer and the exterior wall of the one supporting tube, wherein the radiator layer comprises a material with Z>70, wherein the supporting tube comprises a material with Z<31, wherein the fluid circulates in the supporting tube;

wherein the electron source provides an electron beam comprising electrons of energy of at least 1 MeV, and wherein a tube interior radius is larger than a thickness of the one supporting tube exterior wall at all points on the exterior wall; and wherein a tube interior diameter is larger that a width of the radiator layer, further comprising a beam position monitor system.

14. The system of claim 13, wherein said radiator layer has a thickness less than that necessary to stop the electron beam, such that stray radiation from the bremsstrahlung beam at larger angles from said radiator layer is suppressed relative to stray radiation from the bremsstrahlung beam at larger angles from a radiator layer of sufficient thickness to stop the electron beam.

15. The system of claim 13, wherein the radiator layer is between about a critical thickness and about a thickness such that stray radiation from the bremsstrahlung beam at larger angles is suppressed by a factor of two relative to stray radiation from a radiator layer of sufficient thickness to stop the electron beam.

16. The system of claim 13, wherein the radiator layer is between about a critical thickness and about a thickness such that stray radiation from the bremsstrahlung beam at larger angles is suppressed by a factor of ten relative to stray radiation from a radiator layer of sufficient thickness to stop the electron beam.

17. The system of claim 13, wherein the radiator layer is between about a critical thickness and about a thickness such that stray radiation from the bremsstrahlung beam at larger angles is suppressed by a factor of a hundred relative to stray radiation from a radiator layer of sufficient thickness to stop the electron beam.

18. The system of claim 13, wherein the radiator layer is about a critical thickness.

19. The system of claim 13, wherein the radiator layer is thinner than about a critical thickness.

20. The system of claim 13, wherein the supporting tube has a rectangular cross section.

21. The system of claim 13, wherein the beam position monitor system comprises a plurality of beam position monitors positioned symmetrically with respect to the electron beam.

22. The system of claim 21, wherein the beam position monitors comprise upper plate pick-ups disposed parallel to and on either side of the supporting tube proximate the exterior wall of the supporting tube opposite a portion of the exterior wall on which the radiator layer is disposed.

23. A system for generating a bremsstrahlung beam containing photons of energy of at least 1 MeV. for illuminating a downstream target, comprising a) an electron source, b) one tube, and c) a fluid, wherein the one tube is positioned such that an entire cross-section of an electron beam from the electron source is incident directly upon an exterior wall of the one tube, wherein the tube comprises a material with Z<31, wherein the fluid circulates in the tube;

wherein the electron source provides an electron beam comprising electrons of energy of at least 1 MeV, wherein the tube comprises a material chosen from the group titanium, aluminum, vanadium and steel, and wherein a tube interior radius is larger than a thickness of the one tube exterior wall at all points on the exterior wall.

24. The system of claim 23, wherein the tube comprises titanium.

25. The system of claim 24, wherein the exterior wall of the tube is about 0.03 cm thick.

26. A system for generating a bremsstrahlung beam containing photons of energy of at least 1 MeV. for illuminating a downstream target, comprising a) an electron source, b) one tube, and c) a fluid, wherein the one tube is positioned such that an entire cross-section of an electron beam from the electron source is incident directly upon an exterior wall of the one tube, wherein the tube comprises a material with Z<31, wherein the fluid circulates in the tube;

wherein the electron source provides an electron beam comprising electrons of energy of at least 1 MeV, wherein the tube has a circular cross section;

wherein the tube has a diameter of between about 4 cm and about 6 cm, and wherein a tube interior radius is larger than a thickness of the one tube exterior wall at all points on the exterior wall.

27. The system of claim 26, wherein the fluid is water.

28. The system of claim 26, wherein the tube comprises copper.

29. The system of claim 26, wherein the exterior wall of the tube is about 0.03 cm thick.

30. A system for generating a bremsstrahlung beam containing photons of energy of at least 1 MeV. for illuminating a downstream target, comprising a) an electron source, b) one tube, and c) a fluid, wherein the one tube is positioned such that an entire cross-section of an electron beam from the electron source is incident directly upon an exterior wall of the one tube, wherein the tube comprises a material with Z<31, wherein the fluid circulates in the tube;

wherein the electron source provides an electron beam comprising electrons of energy of at least 1 MeV, wherein the tube has a circular cross section;

wherein the tube has a diameter sufficient for the fluid and the exterior wall to stop the electron beam, and wherein a tube interior radius is larger than a thickness of the one tube exterior wall at all points on the exterior wall.

31. A system for generating a bremsstrahlung beam containing photons of energy of at least 1 MeV. for illuminating a downstream target, comprising a) an electron source, b) one tube positioned such that an entire cross-section of an electron beam from the electron source is incident directly upon an exterior wall of the one tube, c) a fluid, and d) a beam position monitor system disposed proximate an exterior wall of the tube opposite a portion of the exterior wall on which the electron beam is incident, wherein the tube comprises a material with Z<31, wherein the fluid circulates in the tube;

wherein the electron source provides an electron beam comprising electrons of energy of at least 1 MeV, wherein the tube has a circular cross section;

wherein the tube has a diameter sufficient for the fluid and the exterior wall to reduce an electron beam intensity such that the beam position monitor system is enabled to monitor a position and an intensity of the electron beam, and wherein the tube interior radius is larger than a thickness of the one tube exterior wall at all points on the exterior wall.

32. A system for generating a bremsstrahlung beam containing photons of energy of at least 1 MeV. for illuminating a downstream target, comprising a) an electron source, b) one tube, and c) a fluid, wherein the one tube is positioned such that an entire cross-section of an electron beam from the electron source is incident directly upon an exterior wall of the one tube, wherein the tube comprises a material with Z<31, wherein the fluid circulates in the tube;

wherein the electron source provides an electron beam comprising electrons of energy of at least 1 MeV, wherein the tube has a circular cross section;

wherein the tube is positioned such that the electron beam from the electron source is incident upon the exterior wall of the tube along the diameter of the tube, and wherein a tube interior radius is larger than a thickness of the one tube exterior wall at all points on the exterior wall.

33. A system for generating a bremsstrahlung beam containing photons of energy of at least 1 MeV. for illuminating a downstream target, comprising a) an electron source, b) one tube, and c) a fluid, wherein the one tube is positioned such that an entire cross-section of an electron beam from the electron source is incident directly upon an exterior wall of the one tube, wherein the tube comprises a material with Z<31, wherein the fluid circulates in the tube;

wherein the electron source provides an electron beam comprising electrons of energy of at least 1 MeV, wherein the tube has an oval cross section, and wherein a tube interior radius is larger than a thickness of the one tube exterior wall at all points on the exterior wall.

34. A system for generating a bremsstrahlung beam containing photons of energy of at least 1 MeV. for illuminating a downstream target, comprising a) an electron source, b) one tube, and c) a fluid, wherein the one tube is positioned such that an entire cross-section of an electron beam from the electron source is incident directly upon an exterior wall of the one tube, wherein the tube comprises a material with Z<31, wherein the fluid circulates in the tube;

wherein the electron source provides an electron beam comprising electrons of energy of at least 1 MeV, wherein a tube interior radius is larger than a thickness of the one tube exterior wall at all points on the exterior wall and further comprising a beam position monitor system.

35. The system of claim 34, wherein the exterior wall of said tube has a thickness less than that sufficient to stop the electron beam, such that stray radiation from the bremsstrahlung beam at larger angles from said exterior wall is suppressed relative to stray radiation from the bremsstrahlung beam at larger angles from an exterior wall of sufficient thickness to stop the electron beam.

36. The system of claim 34, wherein the exterior wall of said tube is between about a critical thickness and about a thickness such that stray radiation from the bremsstrahlung beam at larger angles is suppressed by a factor of two relative to stray radiation from an exterior wall of sufficient thickness to stop the electron beam.

37. The system of claim 34, wherein the exterior wall of said tube is between about a critical thickness and about a thickness such that stray radiation from the bremsstrahlung beam at larger angles is suppressed by a factor of ten relative to stray radiation from an exterior wall of sufficient thickness to stop the electron beam.

38. The system of claim 34, wherein the exterior wall of said tube is between about a critical thickness and about a thickness such that stray radiation from the bremsstrahlung beam at larger angles is suppressed by a factor of a hundred relative to stray radiation from an exterior wall of sufficient thickness to stop the electron beam.

39. The system of claim 34, wherein the exterior wall of said tube is about a critical thickness.

40. The system of claim 34, wherein the exterior wall of said tube is thinner than about a critical thickness.

41. The system of claim 34, wherein the supporting tube has a rectangular cross section.

42. The system of claim 34, wherein the beam position monitor system comprises a plurality of beam position monitors positioned symmetrically with respect to the electron beam.

43. The system of claim 42, wherein the beam position monitors comprise upper plate pick-ups disposed parallel to and on either side of the tube proximate the exterior wall of the tube opposite a portion of the exterior wall on which the electron beam is incident.

* * * * *